United States Patent [19]

Huang

[11] Patent Number: 5,054,956

[45] Date of Patent: Oct. 8, 1991

[54] CONDUIT HOLE COVER

[76] Inventor: Cheng-Chih Huang, No. 4, Lane 17, Fu-Kuei Rd., Tai-Shang Li, Kang-Shan Chen, Kaohsiung Hsien, Taiwan

[21] Appl. No.: 517,369

[22] Filed: May 1, 1990

[51] Int. Cl.[5] ..... E02D 29/14; H02G 3/08

[52] U.S. Cl. ..... 404/26; 52/20; 220/3.7; 220/3.8

[58] Field of Search ..... 404/26, 25; 52/19–21; 49/463–466; 220/3.4, 3.7, 3.8, 8; 137/369–371

[56] References Cited

U.S. PATENT DOCUMENTS

| | | | |
|---|---|---|---|
| 1,076,386 | 10/1913 | O'Day | 404/26 |
| 3,318,476 | 5/1967 | Clark | 220/3.7 |
| 3,408,778 | 11/1968 | Mason | 404/26 |
| 3,930,739 | 1/1976 | Larsson et al. | 404/26 |
| 4,548,230 | 10/1985 | Feit | 52/20 |
| 4,621,941 | 11/1986 | Ditcher et al. | 52/20 |
| 4,909,692 | 3/1990 | Hendren | 220/3.7 |
| 4,925,337 | 5/1990 | Spiess et al. | 404/26 |

FOREIGN PATENT DOCUMENTS

| | | | |
|---|---|---|---|
| 263843 | 8/1968 | Fed. Rep. of Germany | 404/26 |
| 2356484 | 5/1975 | Fed. Rep. of Germany | 404/26 |
| 1249860 | 10/1971 | United Kingdom | 404/26 |

*Primary Examiner*—Bruce M. Kisliuk

*Attorney, Agent, or Firm*—Ladas & Parry

[57] ABSTRACT

A covering device for detachably shielding an access hole which is provided on the top portion of a conduit box, includes a fixing member having a peripheral wall defining a top opening and a bottom opening and a base protruding inwardly therefrom; a plurality of bolts being fixed on the base of the fixing member; a plurality of supporting members respectively surrounding the bolts and piled up along the same bolts; a suspension member having a peripheral wall defining an upper opening and a lower opening and a bottom plate protruding inwardly therefrom and being supported by the supporting members. The supporting members are being detachable and replaceable so that the wall of suspension member can be raised or lowered thus enabling the cover of conduit hole to be adjusted to a level with a changing road surface.

4 Claims, 5 Drawing Sheets

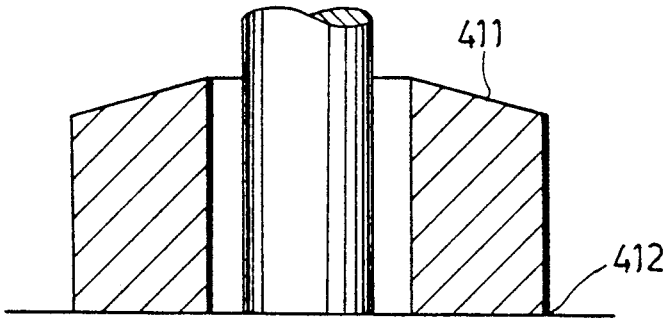
FIG. 5(III)

CONDUIT HOLE COVER

BACKGROUND OF THE INVENTION

The invention relates to a covering device, more particularly to a conduit hole cover that can be raised or lowered in accordance with the surface of a road.

A covering device of the prior art is shown in FIG. 1. It includes a conduit box 1 built in the ground under the surface of the road. A seat 2 mostly made of metal with a base 21 is fixed on said box 1 by means of bolts or screws 211. A cover 3 is positioned on the top portion of said seat 2.

The cover 3 of the conduit hole and the surface 4 of a road should lie in one plane. However, in actual work it is not easy to do so since the relative height of the conduit hole with respect to the concrete box 111, is fixed and the expenditure of repaving the road or reconstructing of the conduit box 1 will be too high and time-consuming.

In view of the above disadvantages, a new covering device has been invented. It provides a covering device which can be raised or lowered in accordance with the surface of a road.

SUMMARY OF THE INVENTION

The object of the present invention is to provide a covering device which can be raised or lowered in accordance with the surface of a road.

According to this invention, a covering device for detachably shielding an access hole, which is disposed on a top portion of a conduit box, includes a fixing member having a peripheral wall with a top opening and a bottom opening, and a bottom seat protruding inwardly from the peripheral wall and surrounding the bottom opening, the bottom seat being adapted to fix on the top portion of the conduit box, aligning the bottom opening of the fixing member with the access hole of the conduit box; a plurality of bolts upwardly fixed on the bottom seat; a plurality of supporting members respectively surrounding the bolts and piled up along the same; and a suspension member removably disposed within the fixing member, the suspension member having a peripheral wall with an upper opening and a lower opening, and a bottom plate protruding inwardly from the peripheral wall of the suspension member, surrounding the lower opening, the bottom plate having plurality of holes formed therealong and passed by the bolts, enabling the suspension member to be suspended by the supporting members; and a cover plate disposed on the suspension member, shielding the upper opening.

BRIEF DESCRIPTION OF THE DRAWINGS

The advantages and features of present invention will become more apparent and easily understood with the accompanying drawings, of which.

DETAILED DESCRIPTION OF THE PREFERRED EMBODIMENT

Figure 1:
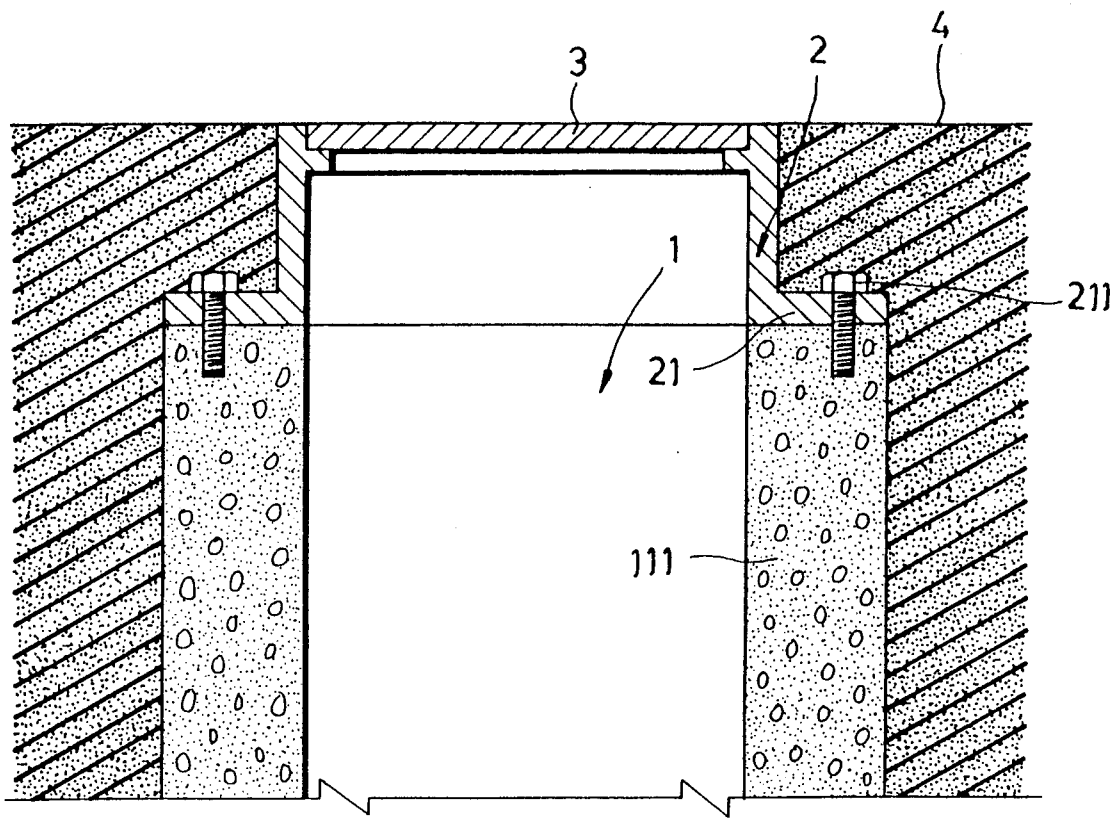
FIG. 1 PRIOR ART
FIG. 1 is the cross sectional view of a conduit hole cover of the prior art.
Figure 2:
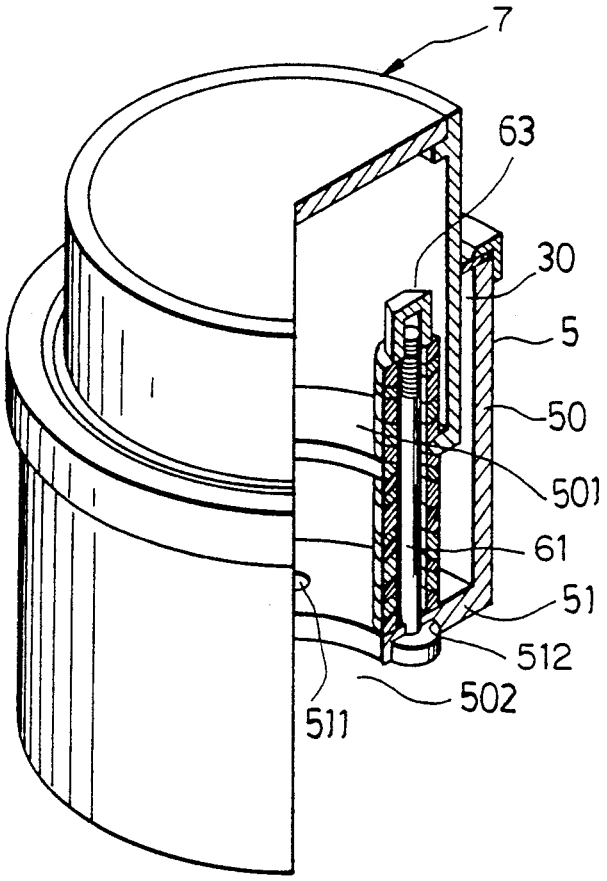
FIG. 2 is partially sectional view of an embodiment of a conduit hole cover according to the present invention.
Figure 3:
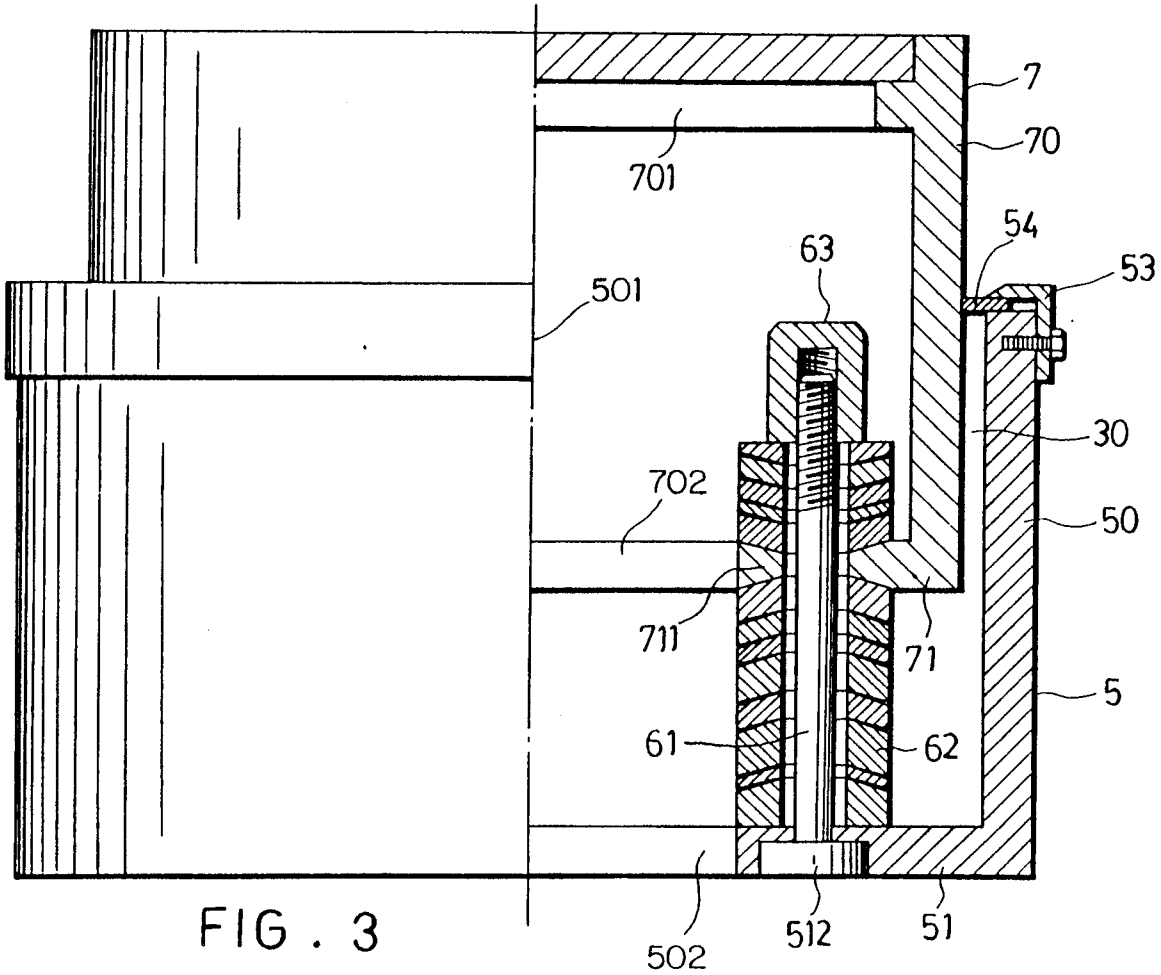
FIG. 3 is a cross sectional view of the embodiment illustrated in FIG. 2.

Referring to FIGS. 2, and 3, the present invention includes a fixing member 5 having a peripheral wall 50 which defines a top opening 501 and a bottom opening 502, a bottom seat 51 protruding inwardly from the peripheral wall 50 of the fixing member 5, and surrounding the bottom opening 502. The bottom seat 51 is fixed to the top portion of the conduit box (not shown FIGS. 2 and 3) by at least a screw hole 511, aligning the bottom opening 502 of fixing member 5 with the access hole of the conduit box (not shown in FIGS. 2 and 3). A plurality of bolts 61 are inserted upwardly through a plurality of holes 512 along the bottom seat 51, being supported by a plurality of supporting members 62. A suspension member 7 has a peripheral of wall 70 which defines an upper opening 701 and a lower opening 702, and also has a bottom plate 71 protruding inwardly from the wall 70 and surrounding the lower opening 702. The bottom plate 71 has a plurality of holes 711 formed therealong which are passed through by the bolts 61 thereby suspending the suspension member 7 by the supporting members 62 which surround said bolts 61 and are piled up along the same bolts 61. The supporting members 62 are held together along the bolts by a plurality of nuts 63. The suspension member 7, being smaller is removably disposed within the fixing member 5. A guarding member 54 is a ring shaped plate, fixed on the top portion of the fixing member 5 by a plurality of clamping members 53, thus surrounding the suspension member 7 and shielding the clearance 30 between the suspension member 7 and the fixing member 5.

Figure 4B:
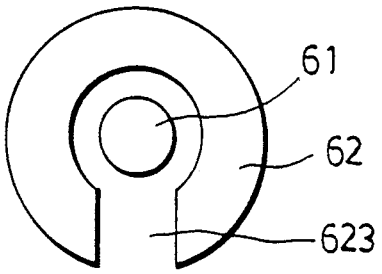
FIG. 4(B) is a top view of FIG. 4(A).
Figure 4A:
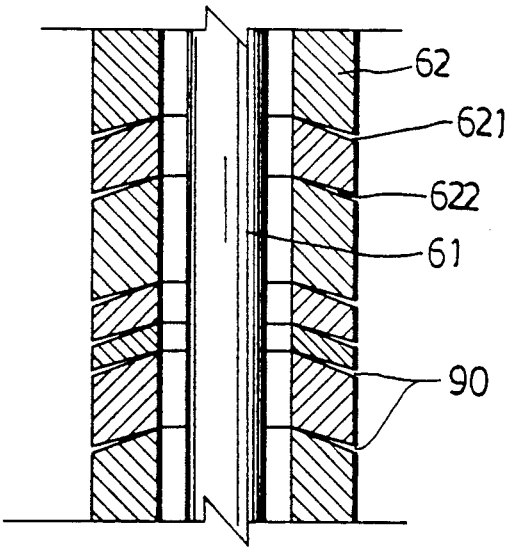
FIG. 4(A) is a sectional fragmentary view of an embodiment illustrated in FIG. 2.

Referring to FIGS. 4(A), 4(B) each of the supporting members 62 are formed as an open annuluses 623 so that the supporting members 62 are detachable and replaceable thus enabling the suspension member 7 to be raised or lowered in accordance with the surface of the road.

Figure 5I:
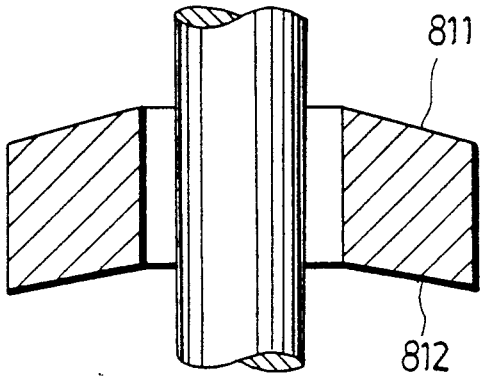
FIGS. 5(I), (II), (III) are cross sectional views of a part of embodiment illustrated in FIG. 4.
Figure 5:
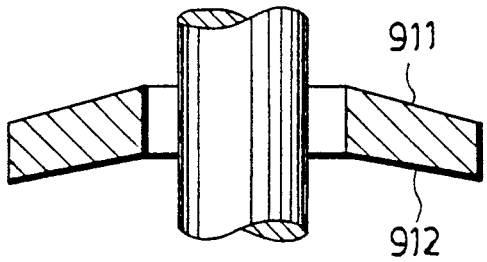

Referring to FIGS. 5(I), (II), (III), there are three kinds of supporting members 62. The first kind has a concave face 812 and a convex face 811. The concave and convex faces are made to compliment and engage each other when stacked. The second kind has a concave face 912 and a convex face 911, the convex face 911 of second kind engages with the concave face 812 of first kind, leaving a clearance 90 (shown in FIG. 4(A)). The concave face 912 of second kind engages with the convex face 811 of first kind, leaving a clearance 90. The third kind has a flat face 412 and a convex face 411, the convex face 411 engaging the concave faces 812, 912 of first and second kinds, leaving a clearance 90. The clearance 90 left between the faces is greatest at the outer rim of the supporting members 62 thus affording the stack a degree of flexibility sufficient to allow the suspension member to have some inclination.

When the cover of a conduit hole is higher than the surface of the road, the wall of the suspension member can be lowered, by removing an appropriate number of supporting members suspending the bottom plate on the bottom seat of the fixing member and inserting those supporting members on the bottom plate of the suspension member. The reverse operation will raise the suspension member so that the cover of the conduit box and the road surface can be in one plane.

With the present invention thus explained it is obvious to those skilled in the art that several modifications and variations can be made without departing from the scope and the spirit of this invention. It is therefore indicated as appended claims.

I claim:

1. A covering device for detachably shielding an access hole which is provided on the top portion of a conduit box, comprising:

a fixing member having a peripheral wall with a top opening and a bottom opening, and a bottom seat protruding inwardly from said peripheral wall and surrounding said bottom opening, said bottom seat being adapted properly to fix on the top portion of said conduit box, aligning said bottom opening of said fixing member with the access hole of said conduit box;

a plurality of bolts upwardly fixed on and allocated around said bottom seat;

a plurality of supporting members respectively surrounding said plurality of bolts and piled up along each of said bolts, each of said supporting members being in shape of open annulus;

a suspension member having a peripheral wall with an upper opening and lower opening, and a bottom plate protruding inwardly from said peripheral wall of said suspension member and surrounding said lower opening, said bottom plate having a plurality of holes formed therealong and passed through by said bolts, whereby said suspension member is supported by said piled up supporting members and mounted within the fixing member; and a covering plate disposed on said suspension member, shielding said upper opening of said suspension member.

2. The covering device as claimed in claim 1, wherein said open annulus supporting members are of a number of different thicknesses and each of said members has a concave internal surface and a convex external surface.

3. The covering device as claimed in claim 1, wherein certain numbers of said supporting members are piled up along each of said bolts, positioned on either sides of said bottom plate of the suspension member and fastened with a nut so that each of said supporting members can be relocated from one side of said bottom plate to another by simply detaching from and clipping on one of said bolts to adjust the position of the suspension member.

4. A covering device for detachably shielding an access hole which is provided on the top portion of a conduit box, comprising:

a fixing member having a peripheral wall with a top opening and a bottom opening, and a bottom seat protruding inwardly from said peripheral wall and surrounding said bottom opening, said bottom seat being adapted properly to fix on the top portion of said conduit box, aligning said bottom opening of said fixing member with the access hole of said conduit box;

a plurality of bolts upwardly fixed on and allocated around said bottom seat;

a plurality of supporting members respectively surrounding said plurality of bolts and piled up along each of said bolts, each of said supporting members being in shape of open annulus;

a suspension member having a peripheral wall with an upper opening and lower opening, and a bottom plate protruding inwardly from said peripheral wall of said suspension member and surrounding said lower opening, said bottom plate having a plurality of holes formed therealong and passed through by said bolts, whereby said suspension member is suspended by said piled up supporting members and mounted within the fixing member;

a covering plate disposed on said suspension member, shielding said upper opening of said suspension member; and a shielding ring being clamped on the rim of the top opening of said fixing member and surrounding said suspension member to seal a clearance between the fixing member and the suspension member.

* * * * *